United States Patent [19]

Tame

[11] Patent Number: 4,796,932

[45] Date of Patent: Jan. 10, 1989

[54] REMOTE RELEASE AND PULL-DOWN UNIT

[75] Inventor: Omar D. Tame, W. Bloomfield, Mich.

[73] Assignee: Hoover Universal, Inc., Ann Arbor, Mich.

[21] Appl. No.: 99,761

[22] Filed: Sep. 22, 1987

[51] Int. Cl.[4] ..... F05B 65/19

[52] U.S. Cl. ..... 292/112; 292/201; 292/341.16; 292/DIG. 43; 74/801

[58] Field of Search ..... 292/11, 56, 96, 112, 292/199, 279, 280, 201, 341.16, 216, 110, 64, DIG. 14, DIG. 43, 341.17; 74/801

[56] References Cited

U.S. PATENT DOCUMENTS

| | | | |
|---|---|---|---|
| 2,896,990 | 7/1959 | Garvey et al. | 292/341.16 |
| 2,898,138 | 8/1959 | Van Noord | 292/341.16 |
| 2,994,550 | 8/1961 | White | 292/341.16 |
| 3,403,934 | 10/1968 | Butts | 292/341.16 |
| 3,835,678 | 9/1974 | Meyer et al. | 292/341.16 |
| 4,223,927 | 9/1980 | Kobayashi et al. | 292/1 |
| 4,518,182 | 5/1985 | Cousin et al. | 292/DIG. 14 |
| 4,652,027 | 3/1987 | Quantz | 292/DIG. 43 |
| 4,671,548 | 6/1987 | Häberle et al. | 292/DIG. 43 |
| 4,707,007 | 11/1987 | Inoh | 292/341.16 |
| 4,746,153 | 5/1988 | Compeau et al. | 292/DIG. 43 |

FOREIGN PATENT DOCUMENTS

| | | | |
|---|---|---|---|
| 3207718 | 9/1983 | Fed. Rep. of Germany | 292/DIG. 43 |
| 58-27457 | 5/1987 | Japan | 292/341.16 |

*Primary Examiner*—Gary L. Smith
*Assistant Examiner*—Eric K. Nicholson
*Attorney, Agent, or Firm*—Harness, Dickey & Pierce

[57] ABSTRACT

A power release and pull-down unit particularly adapted for rear compartment panels of motor vehicles. An electric motor rotationally drives a planetary gear set which in turn drives a latch hook. Limit switches are provided to sense the position of the latch hook such that motor rotation stops once the hook reaches one of two dwell positions. A clutching mechanism is provided to prevent excessive torque from being exerted on the latch hook during panel closure. When the panel is closed against the power unit, the latch hook is moved downwardly to securely close the panel against its sealing gaskets. Movement of the latch hook stops once a cam lobe contacts a limit switch. When the operator wishes to open the panel, motor rotation occurs causing the latch hook to move upwardly and out of engagement with the panel latch striker bar. In this mode, the latch box continues to move until it is in an upwardly extending dwell condition where rotation of the motor again stops through contact between another cam lobe and the limit switch. The unit therefore performs both remote release and pull-down functions and uses an unidirectional drive motor.

18 Claims, 4 Drawing Sheets

REMOTE RELEASE AND PULL-DOWN UNIT

BACKGROUND OF THE INVENTION

This invention relates to a latching device and particularly to one that is electrically operated to release a motor vehicle compartment panel from a closed position and further to pull down the panel against sealing gaskets when it is being closed.

As a convenience feature, motor vehicle manufacturers offer remote control release mechanisms for their vehicles' rear compartment panels which may be in the form of a metal deck lid or rear window backlite. These devices permit the operator to unlatch the compartment panel from the passenger compartment without having to exit the vehicle and release the closure externally. Numerous designs for such devices are presently known and are typically energized by an electrical solenoid.

Vehicle manufacturers take steps to insure that vehicle rear compartments do not leak water, dust and vapors into the vehicle. In order to prevent such leakage, a weather strip or sealing gasket is provided which encircles the rear compartment opening. The performance of the seal is partly dependent upon its degree of compression when the compartment panel is closed against it. Therefore, in order to provide good protection against leakage, significant compression of the seal is required which leads to high closing loads necessary to shut the compartment panel. Closing effort is further increased when the sealing gasket length is large, for example when large area backlites are involved. The requirement of high closing effort is an inconvenience for the user and leads to slamming of the compartment panel causing a "boom" within the vehicle which may be annoying to the occupants.

In view of the foregoing considerations, motor vehicle manufacturers frequently provide a remote release device and a power pull-down unit for the rear compartment panel. The remote release device allows the panel to be unlatched from inside the vehicle, and the pull-down unit enables the user to gently close the panel against the unit where it is engaged and driven to securely close against the sealing gaskets. Remote release devices and pull-down mechanisms are typically provided as individual units and, in combination, can be quite cumbersome, heavy and expensive, since the units must be separately assembled, stocked and handled, and require their own control systems and electrical actuators.

SUMMARY OF THE INVENTION

In accordance with the present invention, a remote release and pull-down unit is provided which performs these functions in a single unit which is actuated by a single electric motor. The unit employs a planetary gear train which causes a latch hook to be moved between latching and unlatching positions. A torque limiting clutch coupling is provided as a user protection feature and further protects the mechanism and compartment panel from damage caused by excessive forces. The drive motor of the device rotates in a single direction to perform the above-noted functions, thus avoiding complications and trade-offs associated with bidirectional drives. In the event of a failure of electrical supply or of the device itself, or for servicing, a manual release system is provided.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
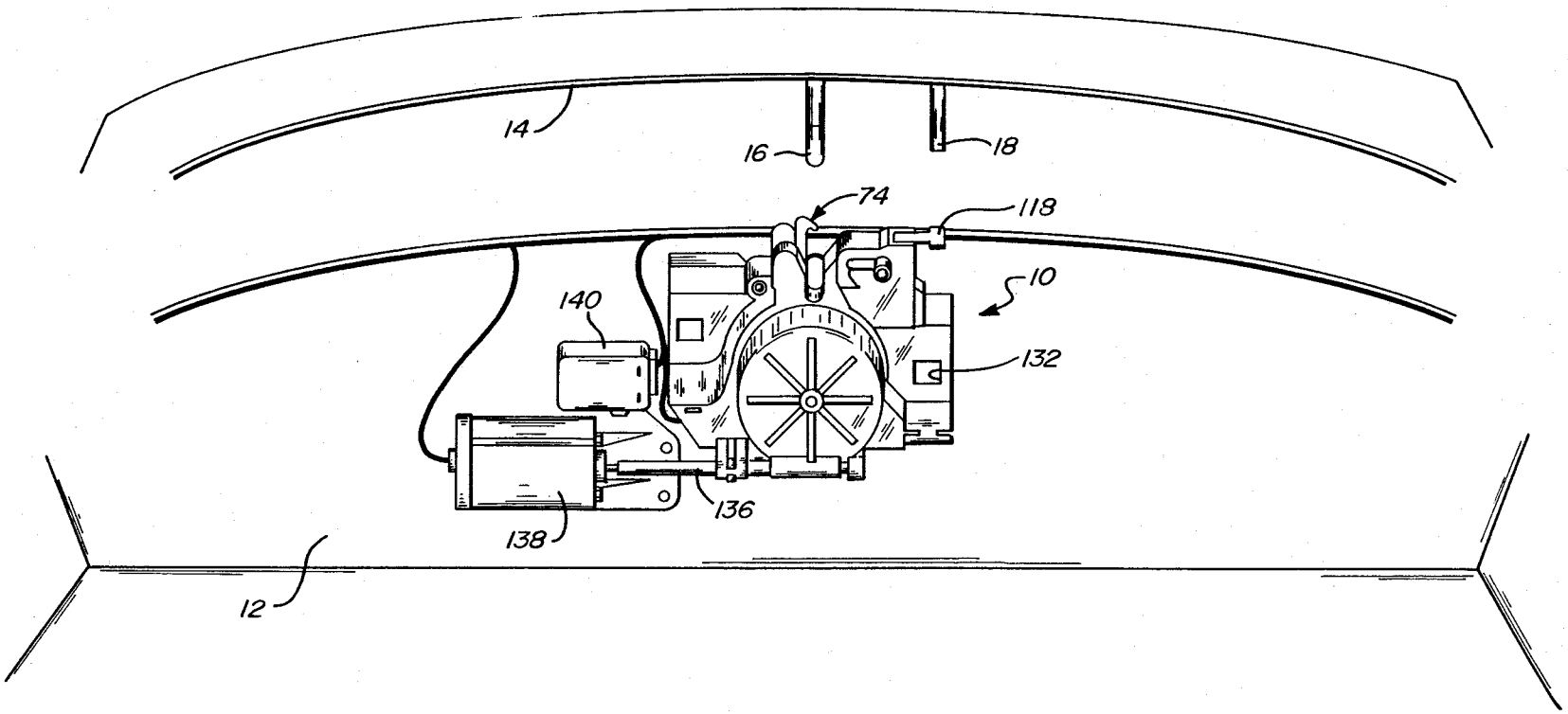
FIG. 1 is a pictorial view from the inside of an exemplary motor vehicle looking rearward and showing the remote release and pull-down unit according to this invention mounted to the rear compartment structure of the vehicle and used in connection with a large area backlite.

A power release and pull-down unit in accordance with this invention is illustrated in FIG. 1 and is generally designated by reference number 10 and is shown mounted to rear compartment panel 12 of a motor vehicle. Unit 10 is employed to release and pull-down compartment panel 14 which is shown in a released condition. Latch striker bar 16 is affixed to panel 14 and is engaged by unit 10. Switch lever post 18 is also carried by panel 14 and performs a control function as will be explained in detail below.

Figure 2:
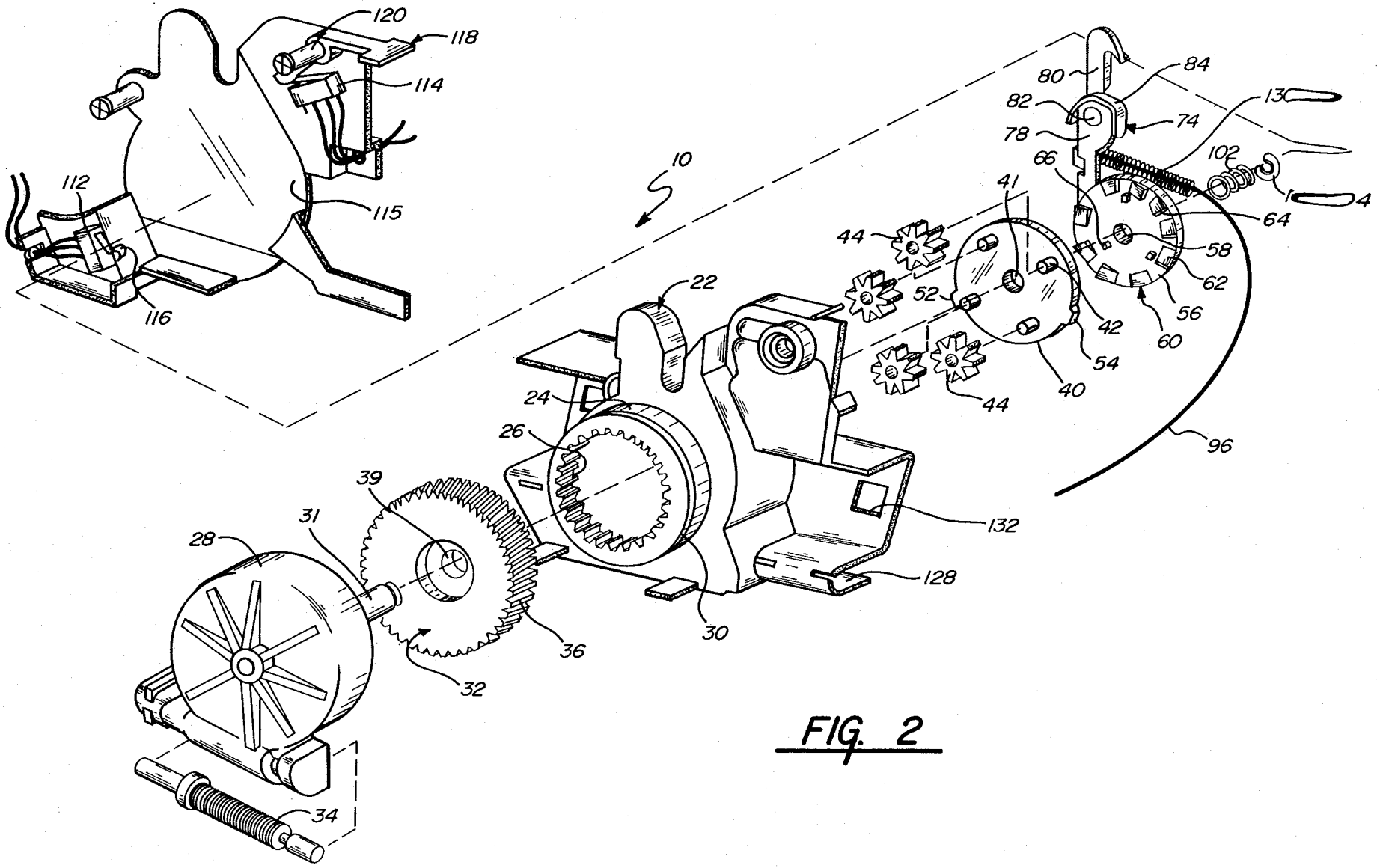
FIG. 2 is an exploded pictorial view of the internal components of the device according to this invention.

The internal components of power release and pull-down unit 10 are best described with reference to FIGS. 2 and 3. Transmission housing 22 forms an interior cavity which contains many of the components of the unit, and further forms a generally cylindrical boss 24 having an internally toothed gear surface 26. Cup shaped drive gear housing 28 snap fits over boss 24 and is retained there by a rib (not shown) which is received by groove 30. Drive gear housing 28 supports an extending shaft 31 which is formed integrally with the housing, or is provided as a separate component which is press fit or formed in place into the housing. Drive gear housing 28 encloses bevel drive gear 32 and worm gear 34. Drive gear 32 defines gear surface 36 which meshes with worm gear 34, and a smaller diameter sun gear 38, and further has a central bore 39 which receives shaft 31. When drive gear housing 28 is installed onto boss 24, sun gear 38 is located in the same radial plane as gear surface 26, and is concentrically located therein.

Planetary gear plate 40 includes a central bore 41 which receives shaft 31, and four longitudinally projecting planet gear posts 42 with planet gears 44 journaled for rotation thereon. Planet gears 44 mesh with sun gear 38 and gear surface 26. Accordingly, rotation of worm gear 34 causes sun gear 38 and planet gears 44 to rotate. Since planet gears 44 also mesh with stationary gear surface 26, planetary gear plate 40 is caused to rotate at a highly reduced rate as compared with the rate of rotation of worm gear 34.

On the opposite side of planetary gear plate 40 from posts 42, a series of circumferentially spaced teeth 46 are formed, each having ramp surfaces 48 and 50. Plate 40 further has three notches 51 which are unequally spaced radially and/or angularly to perform an indexing function, as explained hereinafter. Planetary gear plate 40 further defines a pair of radially projecting limit switch contacting cam lobes 52 and 54 which enable two rotational positions of the planetary gear plate to be sensed.

Figure 3:
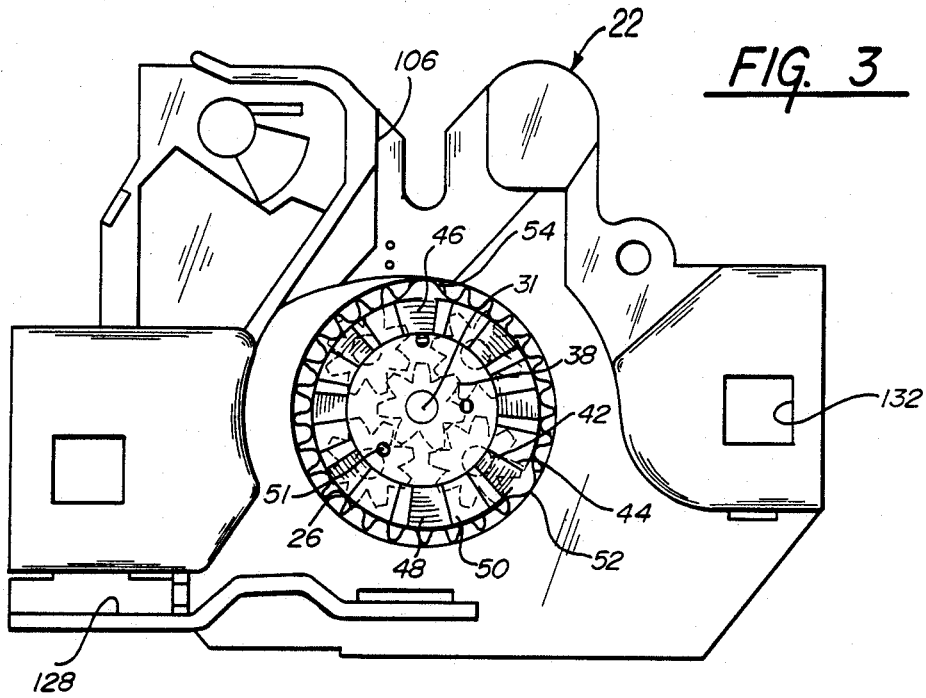
FIG. 3 is a partial rear view of the remote release and pull-down unit according to this invention.

As best shown in FIG. 3, driven plate 56 is journaled for rotation on shaft 31 about bore 58. Like plate 40, driven plate 56 also includes a plurality of radially spaced projecting teeth 60, having ramp surfaces 62 and 64. Driven plate 56 further includes three longitudinal projecting lugs 66 which are located in registry with corresponding notches 51 formed on planetary gear plate 40. Lugs 66 fit into notches 51 only when plates 40 and 56 are in a particular rotated relative position.

Latch hook assembly 74 is mounted to driven plate 56 about post 76 and includes latch lever 78 and latch hook 80 which are connected for relative rotation about post 82. Post 76 is displaced from shaft 31 so that latch hook assembly 74 is driven eccentrically. Latch lever 78 further includes stop tab 83 and contoured flanged surface 84. Latch hook 80 has a pair of deflected tabs 86 and 88. Torsion spring 92 engages latch lever 78 and latch hook 80 at tab 86 to bias them toward the aligned condition shown in FIG. 4. Tab 83 establishes a stop for the rotation of latch hook 80 such that it is rotatable only in one direction (clockwise) from the position shown in FIG. 4. Latch hook tab 88 has a central hole which receives manual release cable 96. Cable 96 has enlarged end 98 which enables tension on cable 96 to be transferred to latch hook 80.

Coil spring 102 is loaded onto shaft 31 and is maintained in that position by keeper washer 104. Coil spring 102 exerts a compression force which urges planetary gear plate 40 against driven plate 56, to provide a torque limiting clutching function as will be described hereinafter.

Now with reference to FIGS. 3 through 6, the configuration of transmission housing 22 will be described. Housing 22 includes a latch hook passage 106 having guide surfaces 108 and 110 which act on latch lever flanged surface 84 to move latch hook assembly 74 vertically and rotationally when driven plate 56 is rotated. A pair of limit switches 112 and 114 are mounted to transmission housing cover 115 which, when mounted, enclose the internal cavity of housing 22. Limit switch 112 has an extending sensing lever 116 which is engaged by cam lobes 52 and 54 when plate 40 is rotated. The lobes and sensing lever 116 are positioned so that limit switch 112 is actuated when gear plate 40 is in the positions shown in FIGS. 4 and 5. Sensor lever 118 is mounted to post 120 of cover 115 and is biased to the position shown in FIG. 4 by torsion spring 122. Sensor lever 118 includes projecting arm 124 and switch contact 126. When compartment panel 14 is closed, switch lever post 18 contacts arm 124 which pulls switch contact 126 away from limit switch 114 to provide a control function to be described later.

Transmission housing 22 further forms spring cavity 128 which retains release spring 130. A pair of mounting holes 132 are provided for mounting unit 10 to the associated structure. Worm gear 34 is rotated via cable 136 by electric motor 138. Control module 140 houses the electronics which control operation of power latch 10.

Figure 4:
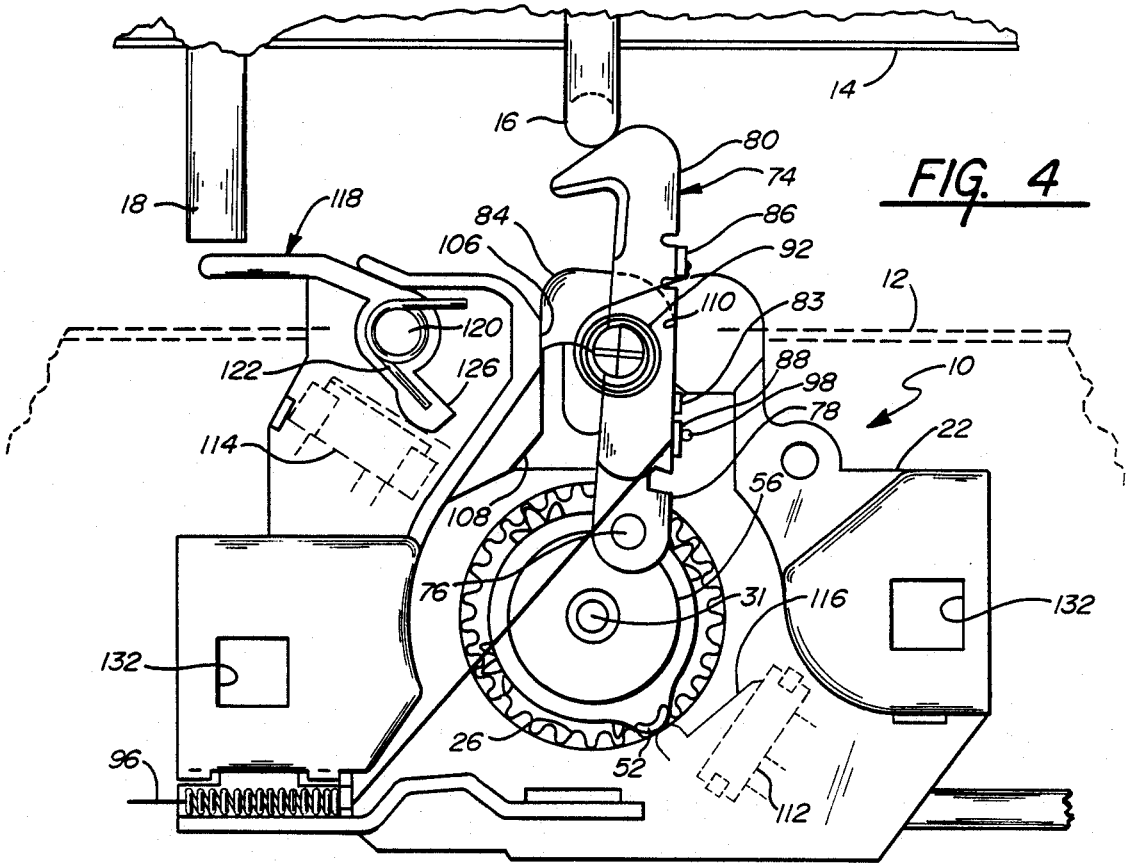
FIG. 4 is a partially cut away elevational view taken from the rear of the associated vehicle showing the release and pull-down unit in a position to engage a compartment panel as it is being closed and to pull the panel down to its normal closed position.
Figure 5:
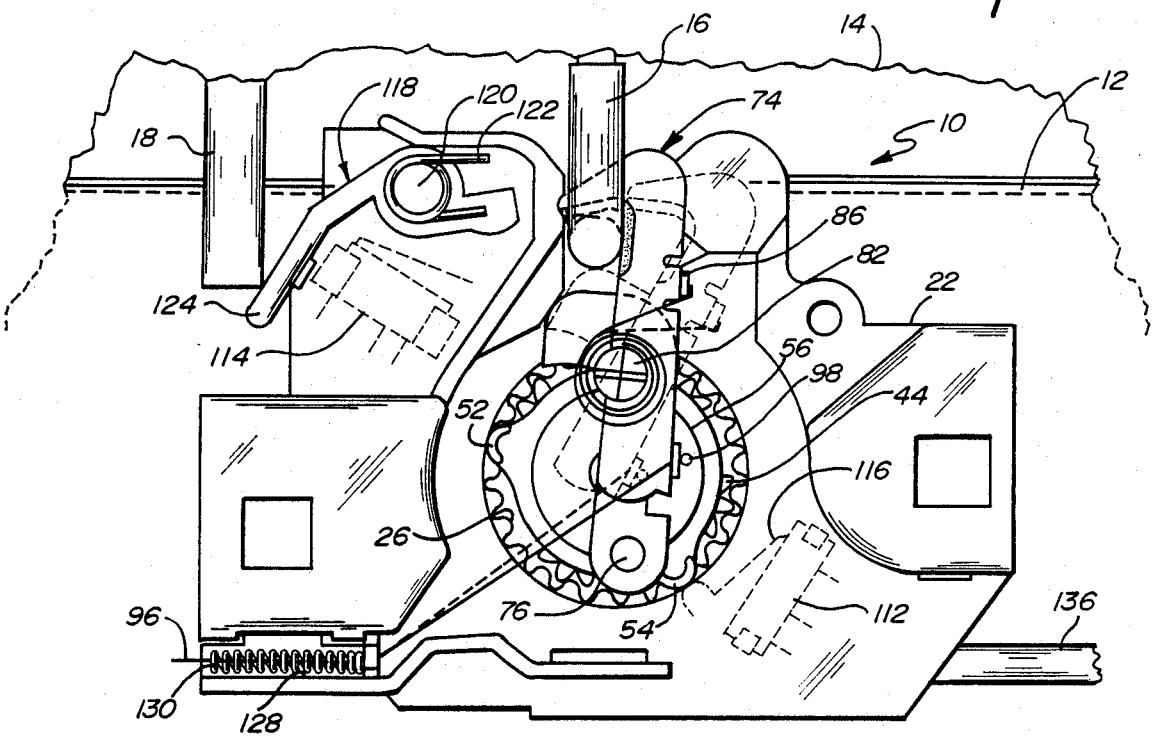
FIG. 5 is a partially cut away elevational view similar to FIG. 4 showing the compartment panel in a fully closed and latched position and further showing in phantom lines the latch bar in a manual releasing position.
Figure 6:
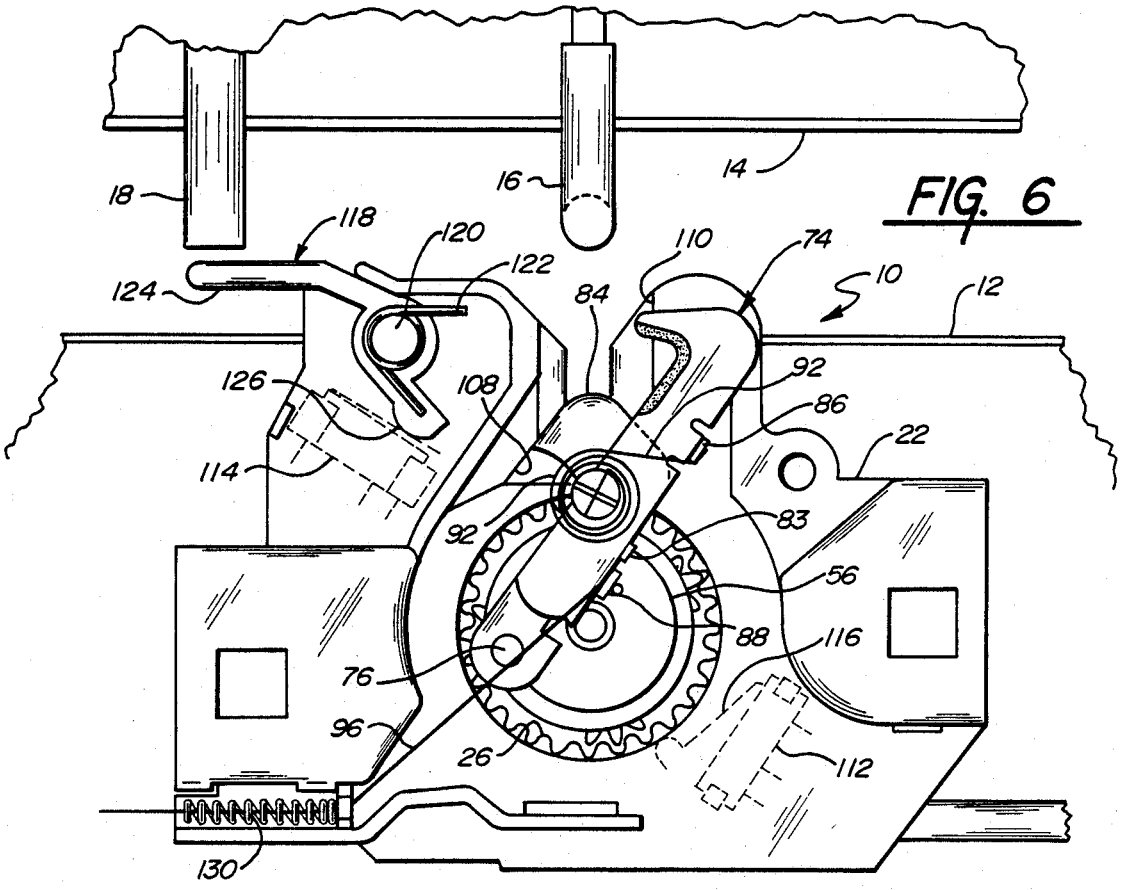
FIG. 6 is a partially cut away elevational view similar to FIG. 4 showing the device in a releasing position, enabling the compartment panel to be opened.

Now with reference to FIGS. 4 through 6, operation of power release and pull-down unit 10 will be described. FIG. 4 illustrates the orientation of the components when the unit is in a released condition enabling the associated compartment panel 14 to be opened. When the user desires to close compartment panel 14, it is shut against power unit 10, causing latch striker bar 16 to contact the upper surface of latch hook 80, causing it to rotate out of alignment with latch lever 78 and engage the latch hook. Simultaneously, switch lever post 18 contacts lever arm 124 and rotates sensing lever 118 causing switch 114 to change its state, which is sensed by control module 140, which in turn energizes electric motor 138. It should be noted that closure of panel 14 causes switch contact 126 to pull away from switch 114, and accordingly, the switch is not damaged if excessive closing force is exerted on the panel. Worm gear 34 is rotated which drives plate 56 in a clockwise direction, with respect to the orientation of components as shown in FIGS. 4 through 6. This rotation causes latch hook 80 to pull down panel 14 and continues until the position shown by FIG. 5 is reached where cam lobe 54 acts on limit switch 112 causing it to change its state, which in turn commands the motor to stop rotation. This position corresponds to the fully closed and latched position of panel 14.

When the user wishes to release panel 14, an electrical signal is provided, either from an interior or exterior mounted switch. This electrical signal causes motor 138 to be again energized, causing continued rotation of plate 56, also in a clockwise direction. During such rotation, latch hook assembly 74 rotates out of engagement with latch bar 16, as shown by FIG. 6, thus permitting panel 14 to be raised by the operator, or by gas springs or other compliant devices acting on the panel. After latch striker bar 16 has escaped from unit 10, plate 56 continues to rotate until lobe 52 acts on limit switch 112 to shut off power to the motor, which occurs once latch hook assembly 74 has assumed the position shown in FIG. 4 where it is positioned to undergo another pull-down cycle as described previously.

In the event that obstacles interfere with the full closure of panel 14, driving plate 56 is rotated in the power pull-down mode until the torque loads acting on driven plate 56 exceed a predetermined level, at which time planetary gear plate 40 and the driven plate are permitted to disengage and rotate relative to each other when teeth 46 and 60 ride over one another in a ratcheting fashion. This clutching feature limits pull-down forces acting on panel 14 which reduce the potential for injury to a person or objects if they interfere with panel closure. Once such relative rotation occurs, lugs 66 disengage notches 51. Since the relative orientation between planetary gear plate 40 and driven plate 56 must be maintained to provide a coordinated relationship between the position of latch hook assembly 74 and cam lobes 52 and 54, relative rotation of the plates is permitted until lugs 66 reengage notches 51. Such relative rotation occurs at low torque levels when lug 66 and notches are disengaged since the lugs maintain teeth 46 an 60 axially separated.

The clutching arrangement provided by planetary gear plate 40 and driven plate 56 also prevents potentially damaging loads from acting on the various structures in the event that a user slams panel 14 against unit 10. In that situation, latch striker bar 16 will forcibly contact latch hook assembly 74 and causes driven plate 56 to disengage plate 40 and rotate it in a clockwise direction. Accordingly, loads on latch striker bar 16 and power latch 10 are limited. The configuration of ramp surfaces 48 and 50, and 62 and 64 are designed to provide a predetermined level of torque prior to permitting relative rotation or "slippage". Since the threshold torsional loads for such relative rotation may be different in the power pull-down mode wherein plate 56 is driven by gear plate 40, and the closing mode wherein plate 56 is driven by latch striker bar 16, the angles and configuration of ramp surface 48 and 62 may be significantly different than that of ramp surfaces 50 and 64.

In the event of a failure of the electrical supply for power unit 10 or of associated components, or during servicing of the unit, panel 14 may be manually released by exerting tension on cable 96. Such tension urges latch hook 80 to be rotated in a clockwise direction against the spring tension exerted by torsion spring 92, thus pemitting latch bar 16 to escape engagement with the hook. This orientation is shown in phantom lines in FIG. 5. The end of cable 96 is maintained under constant low level tension by compression of spring 130 throughout the operating motion of latch hook assembly 74.

While the above description constitutes the preferred embodiments of the present invention, it will be appreciated that the invention is susceptible to modification, variation and change without departing from the proper scope and fair meaning of the accompanying claims.

I claim:

1. A mechanism for releasing a compartment panel of a vehicle from a closed position, and pulling down said panel to said closed position, comprising:

a housing, a rotatable eccentric driving member, means for rotating said eccentric driving member, a latch hook forming a hook end and a pivot, said pivot coupled to said eccentric driving member at a position displaced from the center of rotation of said eccentric driving member, said housing defining cam surfaces acting on said latch hook such that rotation of said eccentric driving member causes said latch hook end to extend from said housing and pivot wherein, in a first position of said eccentric driving member, said hook end engages an engagement feature of said panel and maintain said panel in said closed position, and said eccentric driving member moveable to a second position wherein when said eccentric driving member is moved between said first and second positions, said latch hook pivots causing said hook end to disengage said engagement feature enabling said compartment panel to be released, first switch means for responding to the position of said compartment panel such that when said compartment panel is being closed, said means for rotating is energized causing said eccentric driving member to be rotated from said second to said first position thereby pulling down said compartment panel to said closed position, second switch means for responding to the position of said eccentric driving member for de-energizing said means for rotating to cause said eccentric driving member to dwell at said second position, and third switch means for responding to the position of said eccentric driving member to cause said eccentric driving member to dwell at said first position.

2. The mechanism according to claim 1 further comprising said first switch means including a lever affixed to said housing and contacting a switch, and a post affixed to said compartment panel for contacting said lever when said compartment panel is being closed.

3. The mechanism according to claim 2 wherein said lever moves out of engagement with said switch when said post contacts said lever.

4. The mechanism according to claim 1 wherein said housing defines a gap through which said latch hook extends wherein side surfaces of said gap define said cam surfaces.

5. The mechanism according to claim 1 wherein said eccentric driving member is in the form of a generally circular plate, said plate having a post extending therefrom which is engaged by said latch hook.

6. The mechanism according to claim 5 wherein said plate defines a pair of switch lobes and further comprising a switch which is engaged by said switch lobes when said hook reaches said first or second positions, said switch lobes and said switch defining said second and third switch means.

7. The mechanism according to claim 1 wherein said latch hook includes a latch lever affixed to said eccentric driving member and a hook member rotatably coupled to said latch lever and spring means biasing said latch lever and said hook to one orientation whereby said latch lever can be rotated to engage said engagement feature.

8. The mechanism according to claim 7 further comprising manual release means including a cable coupled to said hook member for urging said hook member to disengage said engagement feature against the force provided by said spring means.

9. The mechanism according to claim 1 wherein said means for rotating said eccentric driving means comprises a worm gear engaging a spur gear having a large diameter section engaging said worm gear and a small diameter sun gear section, and a planetary gear set including planet gears meshing with said sun gear and a stationary ring gear meshing with said planet gears and a planetary gear plate journaling said planet gears whereby rotation of said worm gear causes said planetary gear plate to rotate at a highly reduced rate.

10. The mechanism according to claim 9 wherein said planetary gear plate forms a series of longitudinally projecting teeth which mesh with correspondingly shaped teeth of said eccentric driving member whereby said teeth act as a clutching mechanism which prevents torques beyond predetermined levels from being transmitted between said planetary gear plate and said eccentric driving member.

11. The mechanism according to claim 10 wherein said clutching mechanism has differing threshold torque levels in relative rotation of said eccentric driving member with respect to said planetary gear plate in one direction of rotation versus the opposite direction of rotation.

12. The mechanism according to claim 9 wherein said planetary gear plate and said eccentric driving member define indexing engagement features to establish a desired rotated relative orientation between said plates.

13. A mechanism for releasing a compartment panel of a vehicle from a closed position, and pulling down said panel to said closed position comprising:

a housing defining an internal cavity and a gap defining a pair of cam surfaces along its side, a worm gear disposed within said housing, a drive gear defining a first diameter gear portion meshing with said worm gear a second diameter portion defining a sun gear, a plurality of planetary gears meshing with said sun gear and with a stationary ring gear formed by said housing, a planetary gear plate supporting said planetary gears, a driven plate, clutching means for coupling said planetary gear plate to said driven plate for limiting the torque transmitted between said plates, a latch hook assembly having a latch lever pinned for rotation with respect to said driven plate, a latch hook pinned for rotation with respect to said latch lever, said latch hook assembly extending through said housing gap and moveable from a first position wherein said latch hook engages an engagement feature of said panel to maintain said panel in a closed position and a second position, wherein when said latch hook assembly moves from said first to said second position, said latch hook disengages said engagement feature enabling said panel to be opened, a shaft carried by said housing for rotatably mounting said drive gear, said planetary gear plate and said driven plate, a sensing lever carried by said housing moveable when said panel is moved towards said closed position, a first switch sensing movement of said lever thereby energizing said driving means to cause said latch hook assembly to move from said second to said first position, and a pair of projecting cam lobes moveable in response to rotation of said planetary gear plate, and a second switch sensing said cam lobes and actuated when said latch hook assembly is in said first and said second positions to cause said latch hook assembly to dwell at said positions.

14. The mechanism according to claim 13 wherein said clutching means comprises teeth on said planetary gear plate meshing with teeth on said driving plate and a spring urging said plates against each other.

15. The mechanism according to claim 13 wherein said cam lobes are formed on said planetary gear plate.

16. The mechanism according to claim 13 further comprising manual release means including a cable coupled to said hook member for urging said hook member to disengage said engagement feature.

17. The mechanism according to claim 13 wherein said clutching mechanism has differing threshold torque levels in relative rotation of said eccentric driving member with respect to said planetary gear plate in one direction of rotation versus the opposite direction of rotation.

18. The mechanism according to claim 13 wherein said planetary gear plate and said eccentric driving member define indexing engagement features to establish a desired rotated relative orientation between said plates.

* * * * *